US006736622B1

(12) United States Patent
Bush et al.

(10) Patent No.: US 6,736,622 B1
(45) Date of Patent: May 18, 2004

(54) SCROLL COMPRESSOR WITH OFFSET SCROLL MEMBERS

(75) Inventors: James William Bush, Skaneateles, NY (US); Alexander Lifson, Manlius, NY (US)

(73) Assignee: Scroll Technologies, Arkadelphia, AK (US)

( * ) Notice: Subject to any disclaimer, the term of this patent is extended or adjusted under 35 U.S.C. 154(b) by 0 days.

(21) Appl. No.: 10/447,077

(22) Filed: May 28, 2003

(51) Int. Cl.[7] ..... F04C 18/04
(52) U.S. Cl. ..... 418/55.2; 418/1
(58) Field of Search ..... 418/55.2, 1

(56) References Cited

U.S. PATENT DOCUMENTS 4,303,379 A 12/1981 Hiraga et al.
4,304,535 A 12/1981 Terauchi
4,477,239 A 10/1984 Yoshii et al.
4,904,170 A * 2/1990 Suefuji et al. ..... 418/55.2
5,318,424 A * 6/1994 Bush et al. ..... 418/55.2
5,344,294 A 9/1994 Itoh et al.
5,458,471 A * 10/1995 Ni ..... 418/55.2

* cited by examiner

*Primary Examiner*—John J. Vrablik
(74) *Attorney, Agent, or Firm*—Carlson, Gaskey & Olds

(57) ABSTRACT

A scroll compressor having a hybrid wrap is defined to have its wrap origin offset from a drive center of both the orbiting and non-orbiting scroll members. The offset is selected in a direction such that it eliminates extremes in the torque curve relative to shaft rotation. In this way, torque reversal is generally eliminated.

8 Claims, 3 Drawing Sheets

SCROLL COMPRESSOR WITH OFFSET SCROLL MEMBERS

BACKGROUND OF THE INVENTION

This invention relates to forming a drive center of the scroll members to be offset from the origin of the wraps, to reduce or eliminate torque reversal.

Scroll compressors are becoming widely utilized in refrigerant compression applications. In a scroll compressor, a pair of scroll members each have a base and a generally spiral wrap interfitting to define compression chambers. One of the two scroll members is caused to orbit relative to the other, and as a result of this action, the compression chambers are reduced in volume, thereby compressing an entrapped refrigerant. An anti-rotation coupling facilitates the orbiting movement of the orbiting scroll.

Historically, scroll wraps were formed as an involute of a circle. More recently, more complex shapes involving a combination of curves, involutes, and other shapes have been utilized to form a so-called "hybrid wrap." Each type of wrap, including traditional involutes of circles, is generated from an origin point which has typically also been the drive center of the scroll member.

Hybrid wraps provide a variety of improvements to the operation and efficiency of a scroll compressor. However, one challenge raised by a hybrid wrap is that they may sometimes generate torque reversal in the anti-rotation coupling. Thus, over a small portion of the rotation angle of the drive shaft, there can be reverse torque being applied by the orbiting scroll to the anti-rotation coupling. This can be undesirable, and can result in excess noise or vibration.

One technique that has been utilized by scroll compressor designers in the past to achieve a reduced size is to offset the wrap origins relative to the drive centers. In particular, the orbiting scroll typically has a boss extending downwardly which receives a drive bearing. An eccentric from the drive shaft extends upwardly into this drive bearing. The drive center of the orbiting scroll could be defined as the center of this boss or bearing. In the past, the origin upon which the orbiting scroll wrap is generated, has been offset from this drive center to result in a smaller housing size. At the same time, the non-orbiting scroll is also offset in the same direction and by the same amount relative to its drive axis, which is typically the center of the drive shaft. Again, this technique has been proposed to achieve a smaller housing size, and as often as not, would actually increase the torque reversal problem mentioned above. Also, it is not believed this technique has been proposed on a hybrid wrap.

SUMMARY OF THE INVENTION

In the disclosed embodiment of this invention, an offset is identified which results in the elimination or reduction of torque reversal, and also smoothes out torque fluctuations during the orbiting cycle of the orbiting scroll.

In a preferred embodiment of this invention, the torque versus drive angle amounts are plotted. A designer looks for the extremes in this torque function. An offset is defined to eliminate these extremes. In general, by finding the lowest negative torque amount, and thus the point of greatest torque reversal, the designer can determine the direction in which to design the offset. In particular, at the angular point of the lowest negative torque, the eccentric is spaced in a particular direction relative to the axis of the drive shaft. It is this direction in which the offset of the orbiting scroll wrap relative to its drive axis should be made. If the selected point is a negative torque point, then one would move the origin of the orbiting wrap more towards the shaft center. On the other hand, if the highest torque point is selected, then you would move the origin of the orbiting wrap away from the shaft center at that location.

By so moving the orbiting wrap origin relative to the drive and shaft centers, a generally sinusoidal function should be placed over the original or nominal torque function that will smooth out extremes, and eliminate torque reversal.

These and other features of the present invention may be best understood from the following specification and drawings, the following of which is a brief description.

DETAILED DESCRIPTION OF A PREFERRED EMBODIMENT

Figure 1:
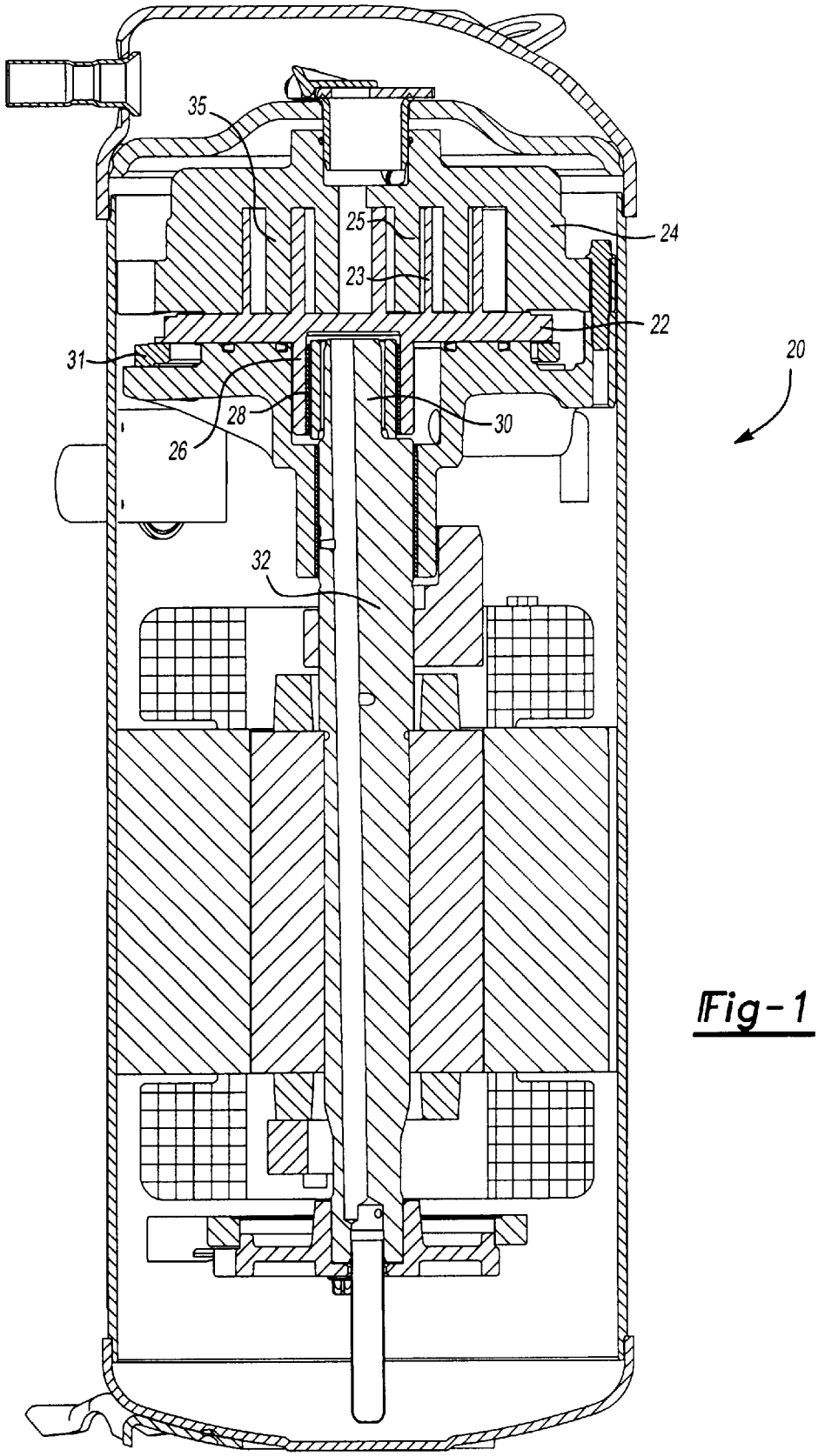
FIG. 1 is a cross-sectional view through a scroll compressor.

As shown in FIG. 1, the scroll compressor 20 incorporates an orbiting scroll 22 having a spiral wrap 23 and a non-orbiting scroll 24 having its own wrap 25. The orbiting scroll 22 incorporates a downwardly extending boss 26 which carries a drive bearing 28. The drive bearing 28 is received on an eccentric pin 30 extending upwardly from a drive shaft 32. As is known, the eccentric pin 30 is eccentric relative to the central axis of the drive shaft 32. An Oldham coupling 31 prevents relative rotation of the orbiting scroll 22, thus causing it to undergo an orbital type motion under the influence of the drive bearing 28 moving about the eccentric radius of the eccentric pin 30. The Oldham coupling 31 prevents the orbiting scroll 22 from rotating under the influence of a torque which is generated by fluid pressures within the compression chambers.

As mentioned above, when the wraps 23 and 25 are of the so-called "hybrid" variety, variations in the fluid pressures within the compression chambers and the shape and location of the chambers themselves may result in torque reversal during the orbiting cycle. At that point, the torque reversal is borne by the Oldham coupling 31, which can sometimes result in undesired noise and vibration.

Figure 2:
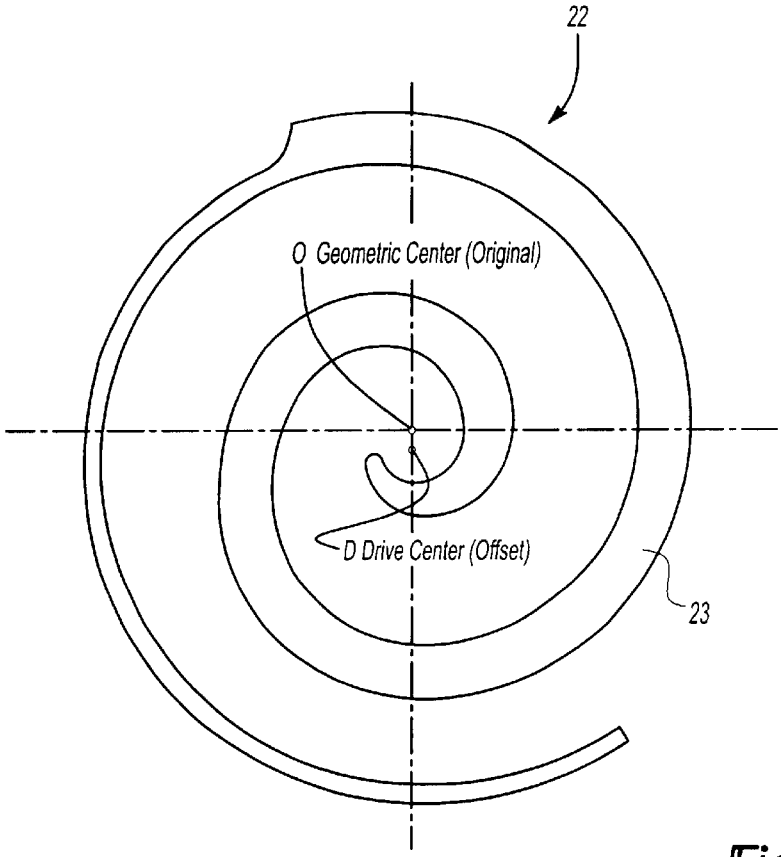
FIG. 2 shows a top view of the orbiting scroll of the inventive scroll compressor.

As shown in FIG. 2, the orbiting scroll 22 has been modified to reduce or eliminate torque reversal. In particular, the geometric center or origin O of the wrap 23 is formed to be spaced from the drive center D by a small offset. The drive center D is generally the center axis of the boss 26 or the bearing 28 for the orbiting scroll.

Figure 3:
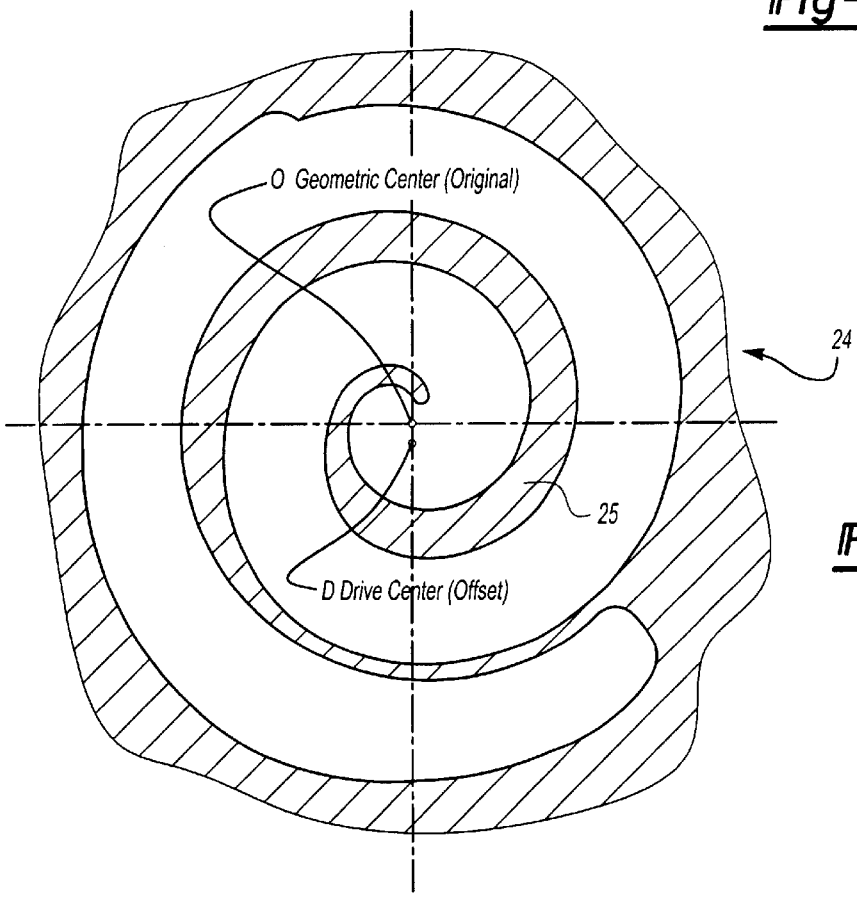
FIG. 3 is a top view of a fixed scroll.

Similarly, as shown in FIG. 3, the fixed scroll has its drive axis, which is the center of the drive shaft 32, offset from the origin O of its wrap 25. As is known, in the formation of a hybrid wrap, one starts with an origin and then plots a series of radii extending from the origin to form the wrap profile. One defining feature of the origin is that the series of radii which form the wrap profile will have little or no sinusoidal component with a period of one revolution. Wrap profiles plotted about an offset center will have a sinusoidal component whose magnitude will roughly correspond to the magnitude of the offset. Thus, the origin is not truly a "center" of the wrap but is a geometric reference point and is a term well known in the art of scroll design.

As is clear from FIGS. 2 and 3, and as is known in the art, a hybrid wrap has a variable thickness along its length, and also the hybrid wraps for the orbiting and non-orbiting scrolls are not necessarily the same. It is this type of wrap which has potential problems with the torque reversal discussed above.

Figure 4:
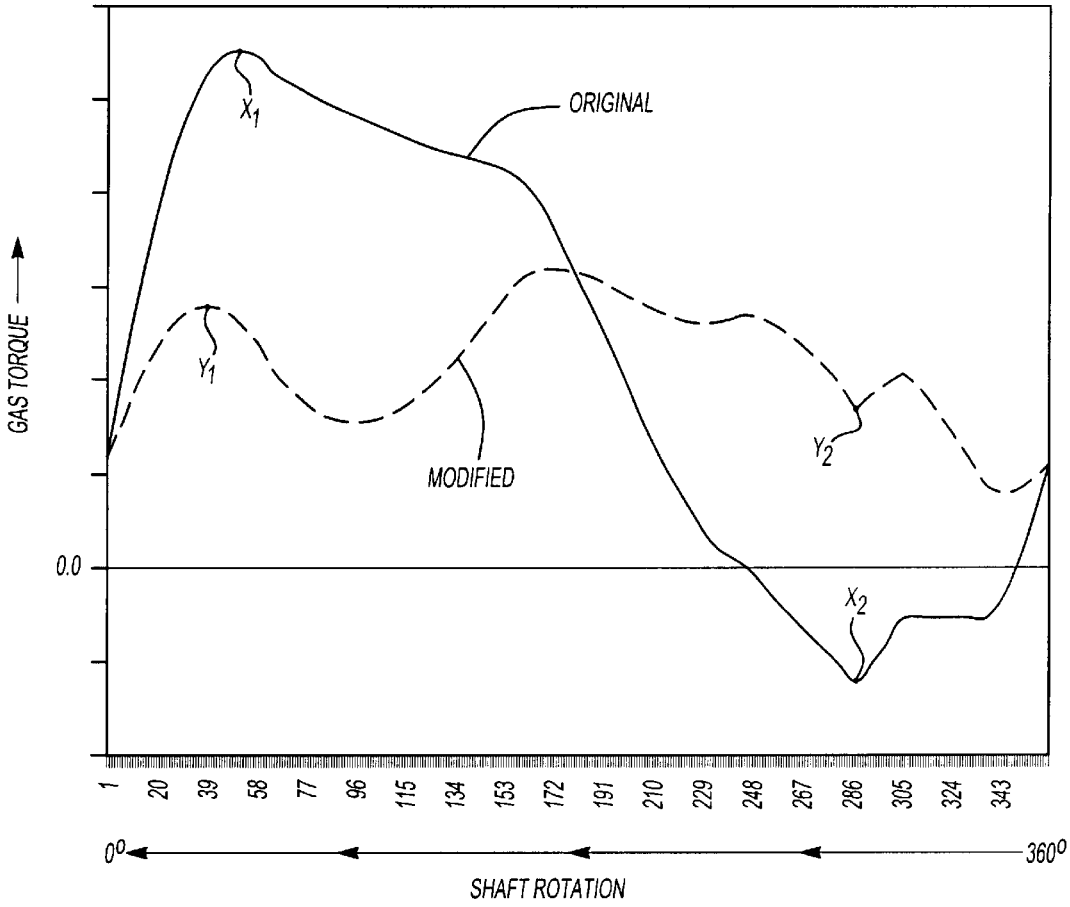
FIG. 4 plots the torque versus drive angle or shaft rotation for both a non-offset scroll and a scroll incorporating the present invention.

FIG. 4 shows graphically how one would achieve a desired offset. As shown in FIG. 4, the original plot of the torque versus the angle of shaft rotation has a highest point $X_1$ and a lowest point $X_2$. At point $X_2$, the torque is below 0, and thus there would be torque reversal. Notably, the torque reversal occurs over approximately 100° of rotation.

The scroll designer would look at this plot and select an extreme point, as an example $X_2$. $X_2$ occurs at approximately 286° of rotation. At that point, the eccentric pin 30 extends in a certain direction relative to the central axis of the drive shaft 32. One would move the origin O from the drive center of the orbiting scroll in that same direction to reduce the torque fluctuation, and eliminate negative torque. Since one is eliminating negative torque, the drive center would be moved toward the shaft center to reduce torque. If instead the designer was looking to eliminated the higher torque point $X_1$, then the center of the boss or the drive center of the orbiting scroll would be moved away from the shaft center in the direction occurring at that drive angle. Typically, either movement would result in a generally similar offset between the origin O and center D for the orbiting scroll. The non-orbiting scroll would also be formed to have the same offset direction and magnitude.

As shown in FIG. 4, with the offset a new torque function would occur across shaft rotation with a highest point $Y_1$ much reduced from the prior highest point $X_1$, and a point $Y_2$ generally associated with the prior $X_2$. Notably, the offset has eliminated torque reversal, and greatly smoothed out any fluctuations in the torque across the shaft rotation range.

Although preferred embodiments of this invention have been disclosed, a worker of ordinary skill would recognize that certain modifications would come within the scope of this invention. For that reason, the following claims should be studied to determine the true scope and content of this invention.

We claim:

1. A scroll compressor comprising:

a first scroll member having a base and a generally spiral wrap extending from said base;

a second scroll member having a base and a generally spiral wrap extending from its base, a drive shaft having an eccentric pin for causing said second scroll member to orbit relative to said first scroll member, said wraps of said first and second scroll members interfitting to define compression chambers which are reduced in volume as the second scroll member orbits relative to said first scroll member;

said wraps of said first and second scroll members each being formed from an origin on said first and second scroll members respectively, and each of said first and second scroll members having drive centers, said drive center of said first scroll member being defined as a central axis of said drive shaft and said drive center of said second scroll member being defined as a center axis of said eccentric pin; and said origin of each of said first and second scroll members being offset in a similar direction from said drive centers of said first and second scroll members, said offset being selected to reduce torque fluctuation and torque reversal during orbital motion of said second scroll member, and said wraps of said first and second scroll members being hybrid wraps, with variable thickness along a circumferential length of said wrap.

2. A scroll compression as recited in claim 1, wherein said offset is defined along a direction selected by studying a torque versus shaft rotation chart and selecting a direction which would tend to reduce or eliminate any sinusoidal torque component with a period of one shaft revolution.

3. A scroll compressor as recited in claim 1, wherein said wraps of said first and second scroll members have different shapes.

4. A scroll compressor as recited in claim 1, wherein said offset is defined along a direction selected by studying a torque versus shaft rotation graph and identifying extreme points in said torque plot without any offset.

5. A scroll compressor as recited in claim 4, wherein a lower most negative torque value is identified, and the offset is selected in a direction of said identified lowest torque value.

6. A scroll compressor as recited in claim 4, wherein the magnitude and direction of said offset is selected so as to reduce the difference in magnitude of said extreme points.

7. A method of forming a scroll compressor comprising the steps of:

providing a first scroll member having a base and a generally spiral wrap extending from said base;

providing a second scroll member having a base and a generally spiral wrap extending from its base, a drive shaft having an eccentric pin for causing said second scroll member to orbit relative to said first scroll member, said wraps of said first and second scroll members interfitting to define compression chambers which are reduced in volume as the second scroll member orbits relative to said first scroll member;

forming said wraps of said first and second scroll members each from an origin on said first and second scroll members respectively, and each of said first and second scroll members having drive centers, said drive center of said first scroll member being defined as a central axis of said drive shaft and said drive center of said second scroll member being defined as a center axis of said eccentric pin, said wraps both being of a hybrid shape with said wraps having a variable thickness along a circumferential length of said wraps; and offsetting said origin of each of said first and second scroll members in a similar direction from said drive centers of said first and second scroll members, said offset being selected to reduce torque fluctuation and torque reversal during orbital motion of said second scroll member.

8. A method of forming a scroll compressor as set forth in claim 7, wherein said wraps of said first and second scroll members have different shapes.

* * * * *

UNITED STATES PATENT AND TRADEMARK OFFICE

CERTIFICATE OF CORRECTION

PATENT NO. : 6,736,622 B1
APPLICATION NO. : 10/447077
DATED : May 18, 2004
INVENTOR(S) : Bush et al.

It is certified that error appears in the above-identified patent and that said Letters Patent is hereby corrected as shown below:

ON THE COVER PAGE:

In the section titled, "Assignee", please change "AK" should be --AR--.

Signed and Sealed this

Twenty-seventh Day of May, 2008

JON W. DUDAS
*Director of the United States Patent and Trademark Office*